US012796822B2

(12) United States Patent
Gooris

(10) Patent No.: US 12,796,822 B2
(45) Date of Patent: Nov. 17, 2026

(54) ERGONOMIC SEAT

(71) Applicant: Workhorse Limited, Hong Kong (HK)

(72) Inventor: Frederic Gooris, Hong Kong (HK)

(73) Assignee: Workhorse Limited, Hong Kong (HK)

( * ) Notice: Subject to any disclaimer, the term of this patent is extended or adjusted under 35 U.S.C. 154(b) by 94 days.

(21) Appl. No.: 18/854,968

(22) PCT Filed: Apr. 17, 2023

(86) PCT No.: PCT/CN2023/088750
§ 371 (c)(1),
(2) Date: Oct. 7, 2024

(87) PCT Pub. No.: WO2023/202539
PCT Pub. Date: Oct. 26, 2023

(65) Prior Publication Data

US 2025/0221537 A1 Jul. 10, 2025

Related U.S. Application Data

(60) Provisional application No. 63/331,866, filed on Apr. 17, 2022.

(51) Int. Cl.
*A47C 7/14* (2006.01)
*A47C 7/00* (2006.01)

(52) U.S. Cl.
CPC ..... *A47C 7/144* (2018.08); *A47C 7/004* (2013.01); *A47C 7/006* (2013.01)

(58) Field of Classification Search
CPC ..... A47C 7/004; A47C 7/006; A47C 7/144; A47C 7/282; B62J 1/005; B62J 1/04
See application file for complete search history.

(56) References Cited

U.S. PATENT DOCUMENTS 1,991,751 A * 2/1935 Kennedy ..... B62J 1/20 297/214
4,848,712 A * 7/1989 Russell ..... A47C 9/10 248/155.2

(Continued)

FOREIGN PATENT DOCUMENTS

CN 2285592 Y 7/1998
CN 204105364 U 1/2015

(Continued)

*Primary Examiner* — Philip F Gabler
(74) *Attorney, Agent, or Firm* — IDEA Intellectual Limited; Sam T. Yip

(57) ABSTRACT

A comfortable ergonomic seat (100) that may be used for chairs, in particular, office chairs, as well as other seating applications including stools, bicycles, fitness equipment, and medical equipment where a user is in a seated position. The ergonomic seat including multi-part open seat frame (10) has at least a first seat sub-frame (11) and a second seat sub-frame (12). The first seat sub-frame (11) and the second seat sub-frame (12) are pivotally connected such that each of the first seat sub-frame (11) and the second seat sub-frame (12) is independently pivotable with respect to each other. This configuration provides a changeable/reconfigurable shape to the multi-part open seat frame (10). A flexible seat cover (20) attached to the multi-part open seat frame (10); the flexible seat cover (20) is deformable according to the changeable shape of the multi-part open seat frame (10) as well as a seated user's personal anatomy.

16 Claims, 19 Drawing Sheets

(56) References Cited

U.S. PATENT DOCUMENTS

| | | | | | |
|---|---|---|---|---|---|
| 5,188,422 | A * | 2/1993 | Montgomery | A47C 9/027 | 108/150 |
| 6,019,425 | A * | 2/2000 | Yates | B62J 1/18 | 297/202 |
| 6,152,524 | A * | 11/2000 | Cox | B62J 1/04 | 297/202 |
| 7,506,925 | B2 * | 3/2009 | Rutherford | B62J 1/00 | 297/215 |
| 7,614,697 | B1 * | 11/2009 | Lai | A47C 1/03255 | 297/301.7 |
| 7,740,308 | B2 * | 6/2010 | Mishly | A47C 4/42 | 248/155.2 |
| 8,602,493 | B1 | 12/2013 | Chen et al. | | |
| 9,102,377 | B2 * | 8/2015 | Reeb | B62J 1/00 | |
| 10,159,351 | B1 * | 12/2018 | Alexander | A47C 7/32 | |
| 11,583,090 | B2 * | 2/2023 | Liu | A47C 9/002 | |
| 2012/0007400 | A1 * | 1/2012 | Behar | A47C 7/462 | 297/285 |
| 2019/0223603 | A1 | 7/2019 | France | | |

FOREIGN PATENT DOCUMENTS

| | | | |
|---|---|---|---|
| JP | 3205436 | U | 7/2016 |
| KR | 20150131693 | A | 11/2015 |
| TW | M366341 | U | 10/2009 |

* cited by examiner

ERGONOMIC SEAT

CROSS-REFERENCE TO RELATED APPLICATION

The present application is the national phase entry of International Application No. PCT/CN2023/088750 filed 17 Apr. 2023, which claims priority to U.S. Provisional Patent Application 63/331,866 filed 17 Apr. 2022, the disclosures of which are incorporated by reference herein.

FIELD OF THE INVENTION

The present invention generally relates to seats for ergonomic chairs, stools, bicycles, fitness equipment, and medical equipment. More particularly, the present invention relates to seats having an open frame with flexible support surfaces.

BACKGROUND

Due to the prevalence of computer usage in offices and other work environments, many people are seated for a large portion of the workday. The typical office chair provides poor positioning of the user, resulting in poor spine health as well as arm and leg strain. Various ergonomic chair solutions have been proposed. However, many of the ergonomic chairs, for example, the so-called "saddle chairs," feature rigid elements that press on sensitive portions of the user's anatomy such as the inner thighs and crotch, leading to a low rate of adoption of such chairs in general work areas.

As a result, there is a need in the art for improved ergonomic seats that are comfortable for prolonged use. The present invention addresses this need.

The present invention addresses the need for comfortable ergonomic seats. The seats may be used for chairs, in particular, office chairs, as well as other seating applications including stools, bicycles, fitness equipment, and medical equipment where a user is in a seated position. In one aspect, the present invention provides an ergonomic seat having a multi-part open seat frame defining an ergonomic seat periphery. The multi-part open seat frame has at least a first seat sub-frame and a second seat sub-frame.

SUMMARY OF THE INVENTION

The first seat sub-frame and the second seat sub-frame are pivotally connected such that each of the first seat sub-frame and the second seat sub-frame is independently pivotable with respect to each other. This configuration provides a changeable/reconfigurable shape to the multi-part open seat frame. A flexible seat cover attached to the multi-part open seat frame, wherein the flexible seat cover is deformable according to the changeable shape of the multi-part open seat frame.

In a further aspect, the pivotal connection may include a mechanical hinge.

In a further aspect, the flexible seat cover is a three-dimensionally knitted fabric seat cover.

In a further aspect, the three-dimensional knitted fabric seat cover includes at least first and second regions of different knitting densities.

In a further aspect, the three-dimensional knitted fabric seat cover includes first and second regions of knitting with different types of knitting yarns or fibers.

In a further aspect, the first region includes a relatively higher knitting density for structural support to transfer a seated user's weight to the multi-part open seat frame, and the second region includes a relatively lower compliant knitting density to yield to the seated user's individual anatomy.

In a further aspect, the multi-part open seat frame includes a curved frame rear portion complementing a shape of a seated user's pelvis.

In a further aspect, a front projection is positioned between a seated user's legs, the open frame and front projection positioning a seated user's back at an angle of between approximately 115-135 degrees with respect to the seated user's thighs.

In a further aspect, a seat tilt adjuster is positioned beneath the multi-part open seat frame.

In a further aspect, the seat tilt adjuster includes a stationary arm pivotally connected to a pivoting arm.

In a further aspect, the pivoting arm includes an adjustable compression spring.

In a further aspect, the pivoting arm further comprises a pivotable spring stop abutting the adjustable compression spring.

In a further aspect, the ergonomic seat includes a seat cover tensioner.

In a further aspect, the seat cover includes a peripheral cable connected to the seat cover tensioner.

In a further aspect, the seat cover tensioner includes one or more projections engaging the seat cover peripheral cable.

In a further aspect, at least one of the one or more projections engaging the seat cover peripheral cable is movable to increase cable tension and seat cover tension.

In a further aspect, the multi-part open seat frame includes at least a portion have a frame cross-section with a curved portion transitioning to a flat lower portion to engage a periphery of the seat cover.

In a further aspect, the ergonomic seat includes a backrest cooperating with the ergonomic seat.

In a further aspect, the backrest includes an open backrest frame, and a flexible backrest cover attached to the open backrest frame.

In a further aspect, the flexible backrest cover is a three-dimensional knitted fabric.

In a further aspect, the three-dimensional knitted fabric backrest includes at least first and second regions of different knitting densities.

In a further aspect, the three-dimensional knitted fabric backrest includes first and second regions of knitting with different types of knitting yarns or fibers.

In a further aspect, in the three-dimensional knitted fabric backrest the first region includes a relatively higher knitting density for structural support to transfer a seated user's weight to the open backrest frame, and the second region includes a relatively lower, compliant knitting density to yield to the seated user's individual anatomy.

In a further aspect, the first and second sub-frames may be oriented side-to-side or front to back of the multi-part open seat frame.

In a further aspect, the first and second sub-frames equally or unequally divide the multi-part open seat frame.

In a further aspect, the backrest is connected to a seat tilt adjuster such that tilting the seat simultaneously tilts the backrest.

DETAILED DESCRIPTION

Figure 1:
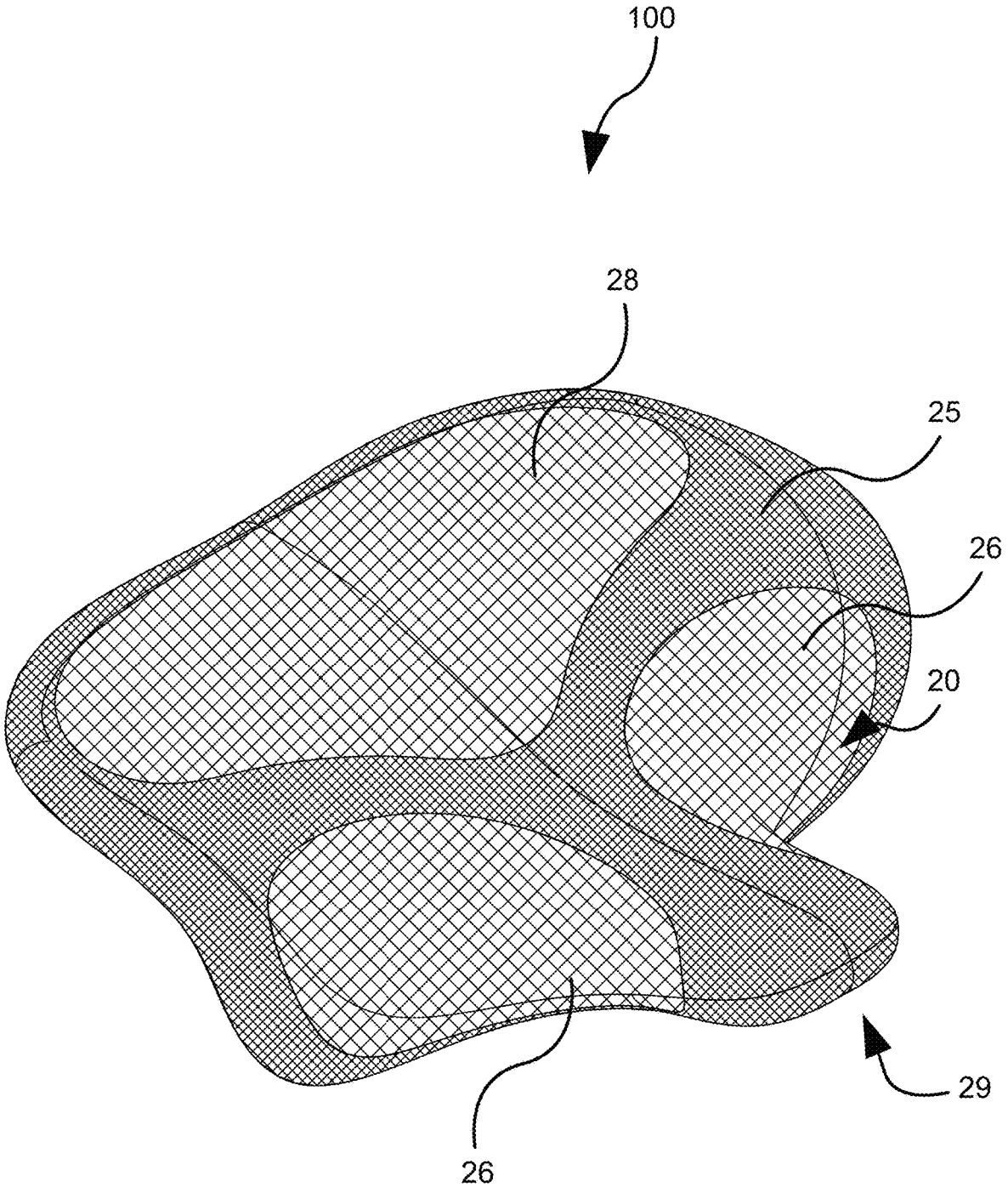
FIG. 1 is a perspective view of an ergonomic seat according to an embodiment.

Turning to the drawings in detail, FIG. 1 depicts a perspective view of an ergonomic seat 100 according to some embodiments. Ergonomic seat 100 generally includes a multi-part open seat frame 10 (best seen in FIG. 2) and a flexible seat cover 20 attached to the multi-part open frame. Note that, although the examples shown in the drawings generally relate to an ergonomic seat for a chair, such as a rolling office chair, seat 100 is not limited to this application. In general, seat 100 may be used in a variety of applications including, for example, stools, bicycle seats, fitness equipment seats, and medical equipment seats.

As used herein, the term "ergonomic" is broadly inclusive of seat frame shapes specifically configured to promote a sitting posture encouraging proper alignment of the shoulders, spine, pelvis, hips, and legs. Some ergonomic seats position a seated user's spine relative to the seated user's upper legs at a natural angular posture for maintaining comfort as well as good spine health. Studies have postulated this angle to be in a range of approximately 115-135 degrees.

Other ergonomic seats are based on curved frame shapes that mimic the human pelvic anatomy. These ergonomic seat frames encourage the bony structures of the pelvic bones to be level with respect to each other, giving the lower back a slight forward arch and preventing posterior pelvic tilt.

Examples of ergonomic seat shapes to which the present invention may be applied includes saddle-shaped seats that generally have a forward angular tilt and a projection extending between the seated user's legs to maintain the position without strain on the thighs and lower legs. Other saddle chairs are similar to a horse saddle and position the seated user's legs further apart. The present invention may be applied to these as well as a variety of other ergonomic positions such as seats promoting a reclined position with elevated feet to maintain proper spine and pelvis alignment.

Figure 2:
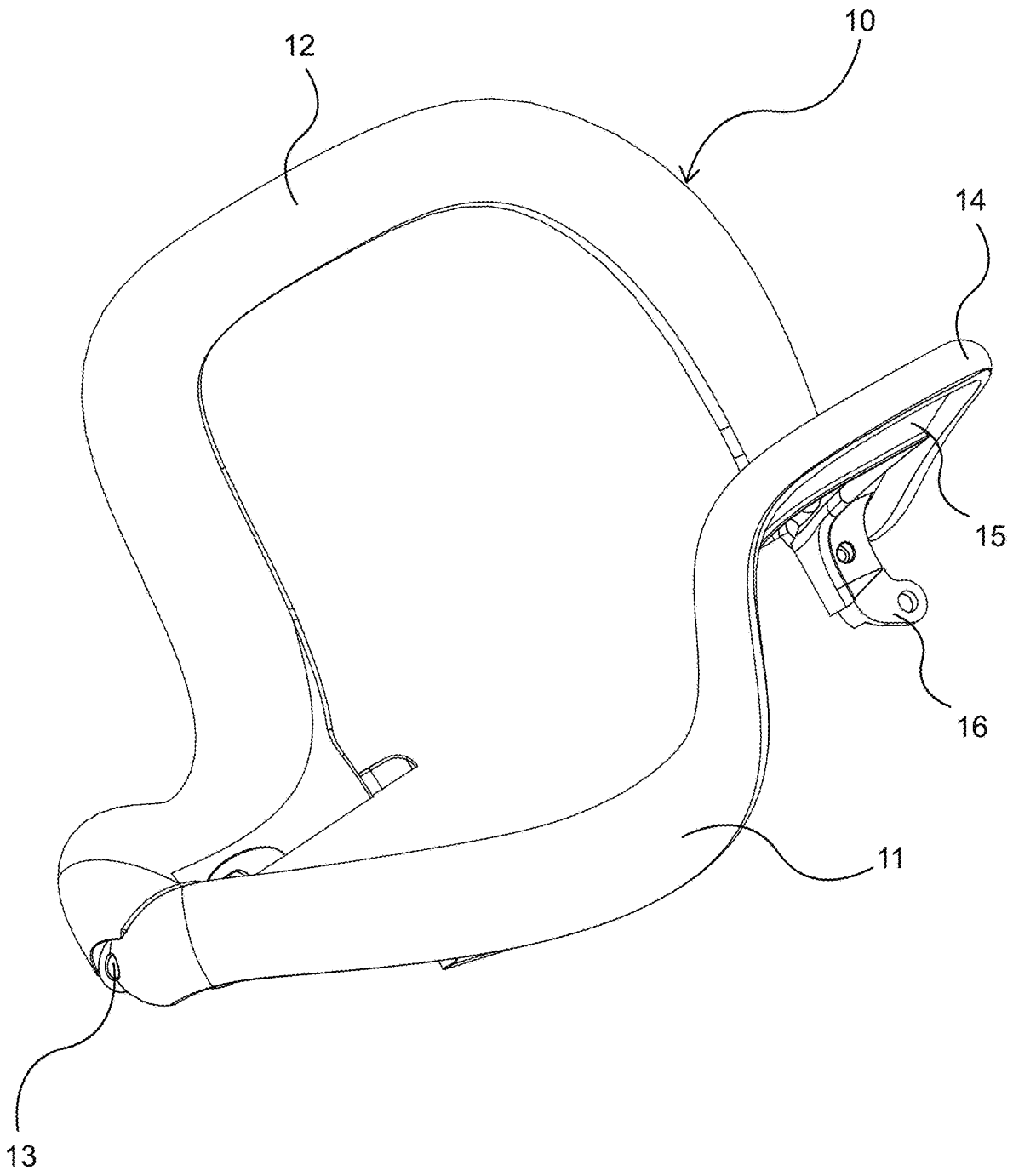
FIG. 2 shows a foldable multi-part open frame of the ergonomic seat of FIG. 1 in a partially-flexed or folded position.
Figure 3:
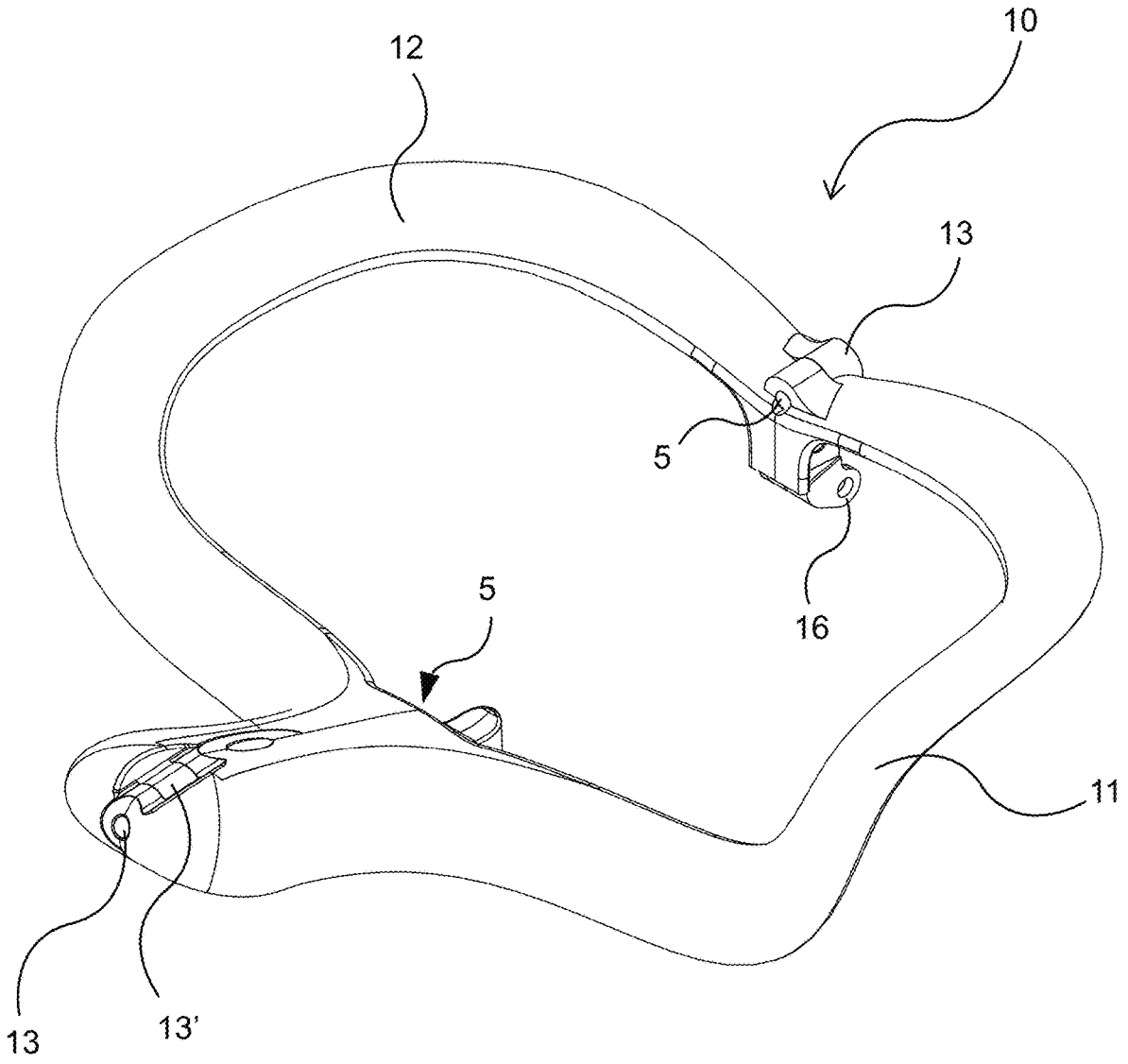
FIG. 3 shows a foldable multi-part open frame of the ergonomic seat of FIG. 1 in an open position.

As seen in FIGS. 2 and 3, the multi-part open frame 10 includes a first seat sub-frame 11 and a second seat sub-frame 12. The first seat sub-frame and the second seat sub-frame are pivotally connected at pivot point 13 such that each of the first seat sub-frame and the second seat sub-frame is independently pivotable with respect to each other. An optional hinge 13' may also be provided. FIG. 2 depicts multi-part open frame 10 in a flexed position, while FIG. 3 depicts the multi-part open frame 10 in an open position. In use, the frame 10 is typically locked in a fully-open position. However, a user may optionally adjust the angles of the first and second sub-frames slightly flexed upward depending upon personal anatomy and comfort preferences.

The sub-frames may be equal or unequal in size; that is, they may divide the frame in half or they may divide any sub-portion of the frame from another sub-portion of the frame. Further, the terms "first" and "second" are arbitrary and, although shown as side-to-side, "first" and "second" may also be the front and rear portion of the frame, depending upon the orientation of the frame and the viewer. In short, the sub-frames may divide any portion of the seat frame at any orientation.

As seen in FIGS. 1-4, the frame 10 may have a rounded upper surface 14 which is both aesthetically pleasing and promotes user comfort by avoiding hard edges. The rounded upper edge further assists in attaching flexible cover 20. Frame 10 may further include apertures 5 for engaging an optional frame axis rod between the first and second frame portions.

Figure 4:
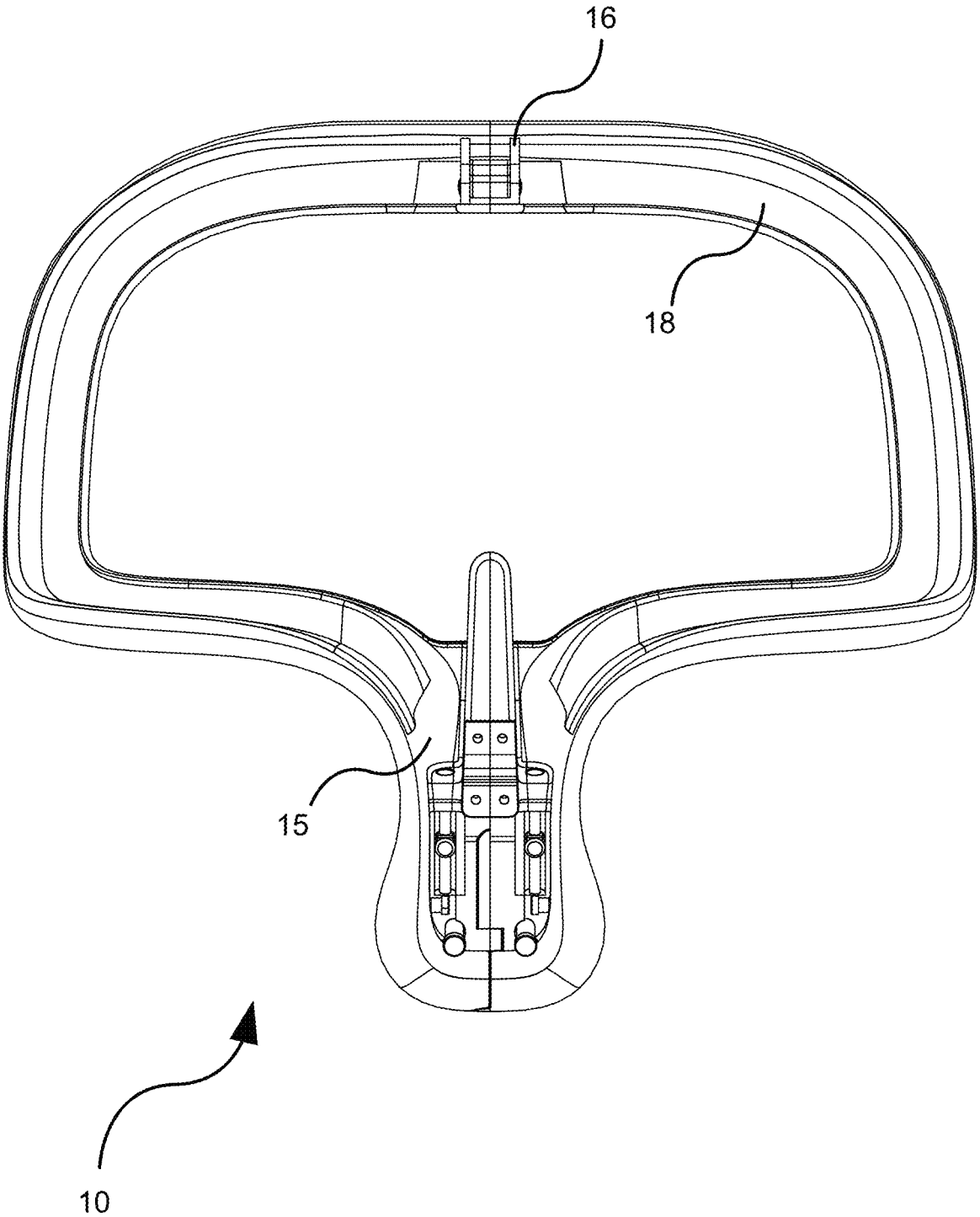
FIG. 4 shows the lower surface of the frame of FIG. 3.
Figure 5A:
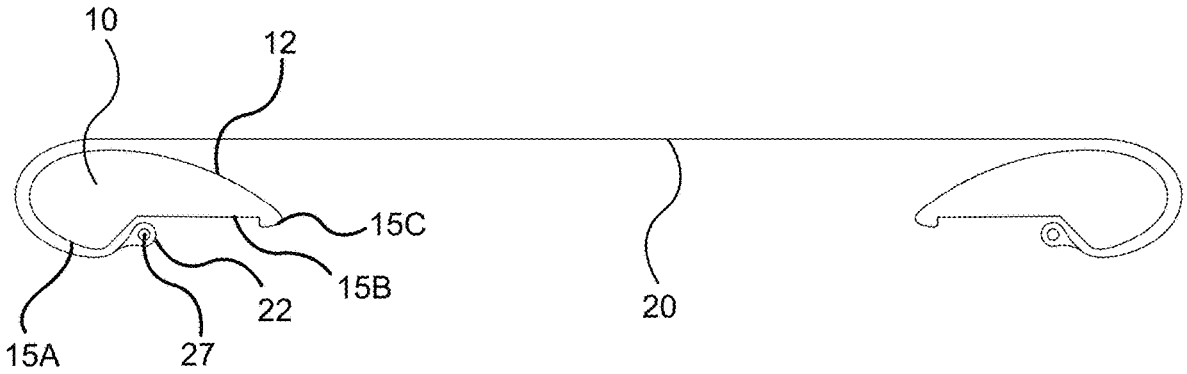
FIGS. 5A-5C show a seat cover attached to the foldable multi-part open frame of the ergonomic seat of FIG. 1.

FIG. 4 shows a frame lower surface of frame 10 while FIG. 5A shows a cross-section of frame 10. Frame lower surface 15 includes a curved portion 15A transitioning to a relatively level portion 15B. The transition point engages a seat cover 20 through attaching member which will be discussed in further detail below. The lower surface also includes an optional edge 15C that cooperates with an optional lower frame cover.

Flexible seat cover 20 may be selected from a wide variety of materials, including woven and non-woven fabrics as well as knits, which are described in more detail below. Because seat cover 20 is flexible, it is deformable according to the changeable shape of the multi-part open ergonomic seat frame 10 as well as custom deforming to a seated user's anatomy.

A variety of techniques may be optionally used to attach the flexible seat cover 20 to the frame 10. These include adhesive bonding in which cover 20 is glued directly to frame 10. Alternative, mechanical fasteners, such as staples, screws, or clips can attached flexible cover 20 to frame 10. Hook-and-loop fasteners such as Velcro may also be used when removable covers are desired. When Velcro is used, a strip of Velcro is attached to either chair frame 10 or to cover 20 with a mating strip on cover 20. In this manner, the cover 20 is connected to itself while wrapping frame 10 or attached directly to the frame 10. Cover 20 may then be easily removed for cleaning or replaced when worn or damaged. Finally, a pocket may be formed along the periphery of cover 20 using an adhesive or by sewing as it wraps frame 10. However, these techniques are generally more suitable when the seat frame has a relatively "flatter" two-dimensional shape.

Figure 5B:
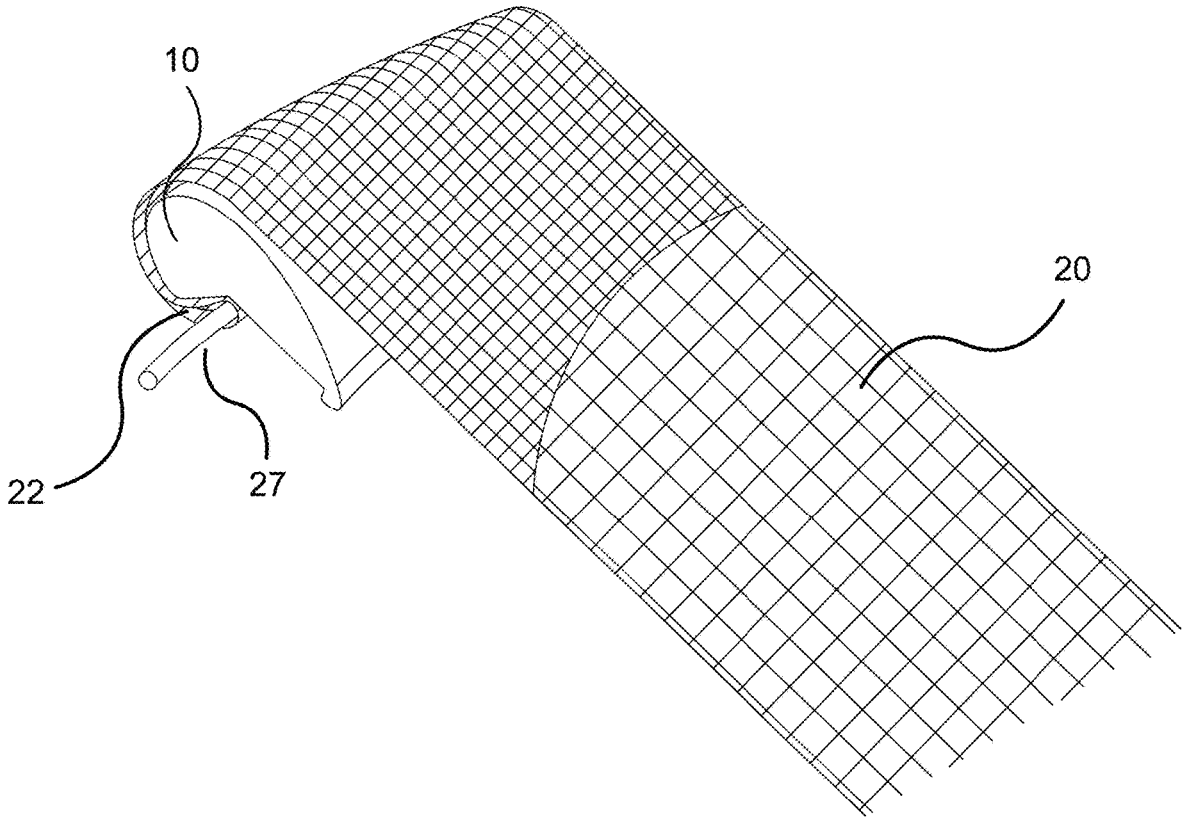
Figure 5C:
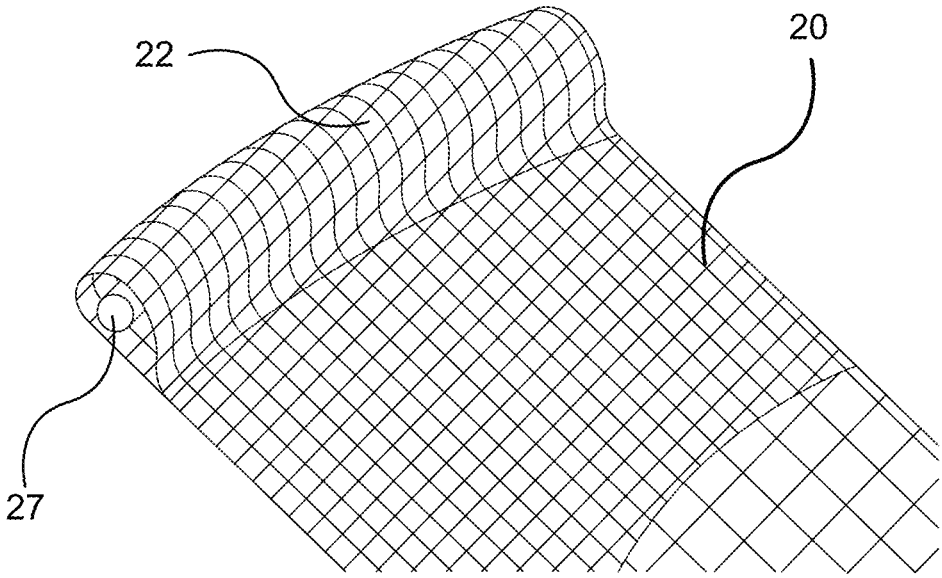

Since the embodiment of FIG. 1 uses an ergonomic 3D seat frame 10 with numerous complex curves in order to complement the shape of the human pelvis, flexible cover 20 may be attached to frame 10 using one or more flexible cables 27. The cables 27 are selected from flexible elongated materials such as steel or plastic wires, and are woven or sewn into the edges of the cover 20, e.g., in a seat cover pocket 22 at the cover periphery as seen in FIGS. 5A-5C. Pocket 22 may be formed by sewing, gluing, or otherwise fastening the flexible cover upon itself or using an additional piece of fabric or other flexible material secured to cover 20. Inserted into the pocket 22 is cable 27 that traverses the periphery of seat cover 20.

Because the seat frame 10 is foldable, a length of seat cover cable 27 may be shorter than the perimeter of frame 10 in its fully-open position. That is, frame 10, in a folded or partially-folded configuration, can readily accommodate the seat cover with a shorter cable length during seat assembly. As the folded or partially-folded frame 10 is opened, cable 27 is tensioned around the perimeter of frame 10, and, in turn, flexible cover 20 is stretched to create a tight, even fit, enabling the flexible material of cover 20 to conform to the contours of the seat frame 10 and maintain its shape over time. Since the length of the cable 27 is shorter than the perimeter of frame 10, and is engaged at the transition between curved frame edge 15A and level portion 15B, once the cover 20 is positioned over the frame, the cover cannot slide over the frame edge 15A and disengage from the frame 10. Although the cover cannot slip off the frame in its fully-opened configuration, when the frame is folded, the cover may be easily removed for cleaning or replacement.

To enhance chair aesthetics as well as further secure the seat cover, an additional frame lower surface cover 18 may be positioned over the cover edge, creating a seamless appearance, as seen in the bottom view of FIG. 4. Lower surface cover 18 is held within surface 15B and edge 15C and is further secured with fasteners to frame 10.

Figure 5D:
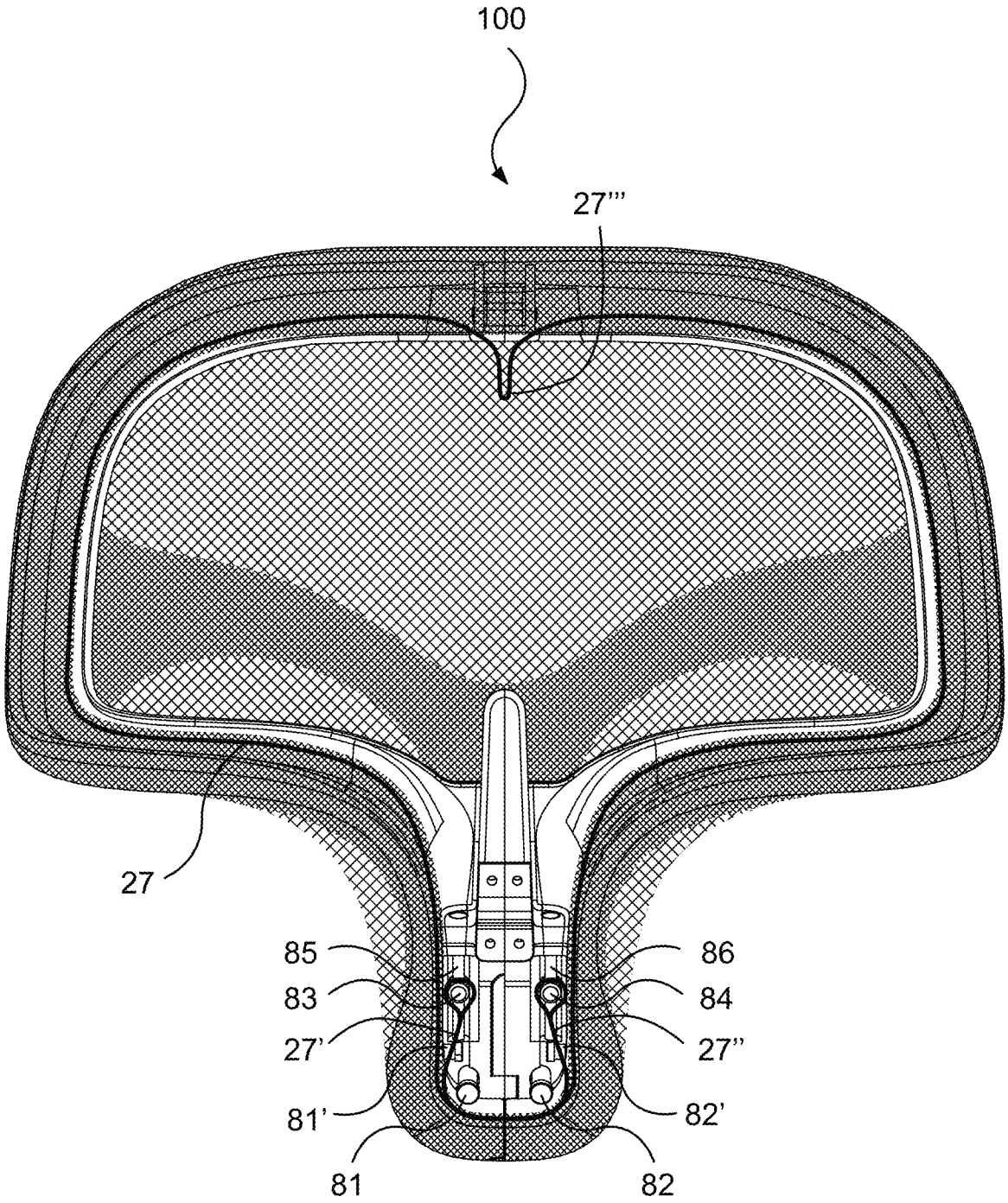
FIG. 5D shows a bottom view of the ergonomic seat of FIG. 1.
Figure 5E:
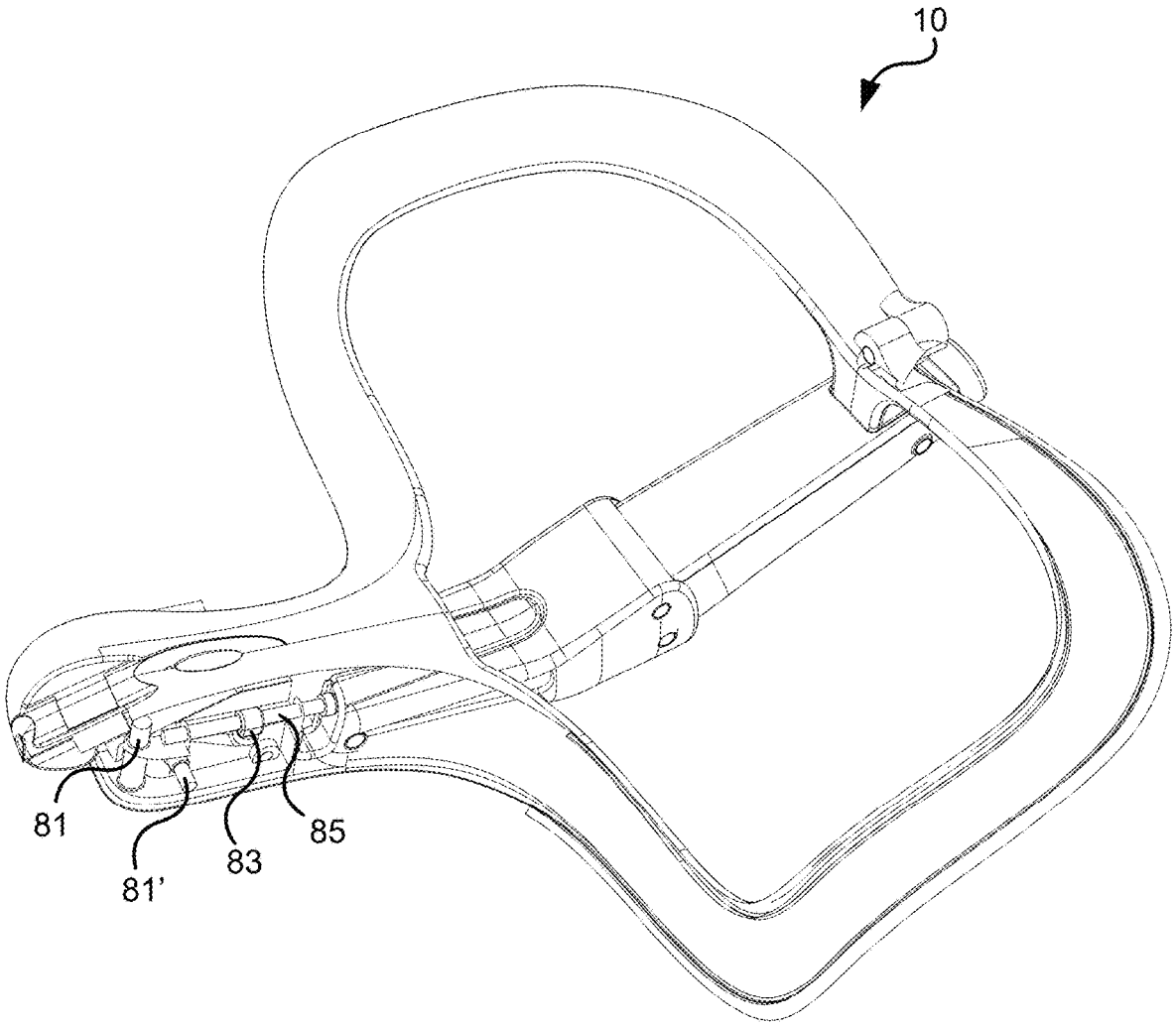
FIG. 5E shows an enlarged view of an optional seat tensioning system for the ergonomic seat of FIG. 1.

FIG. 5D depicts one embodiment of ergonomic seat 100 using a cable 27 attached along the periphery of seat cover 20. Cable portion 27''' extends from cover 20 to engage a rear portion of frame 10. In FIG. 5D, an optional seat cover tensioning system 80 is provided. The purpose of optional seat cover tensioning system 80 is three-fold. First, tensioning system 80 may be used during initial chair assembly to ensure adequate seat cover tension without sagging regardless of size deviations occurring during cover manufacture. Second, tensioning system 80 may be used to tighten seat cover 80 after periods of extended use (e.g., due to stretching of seat cover 80 from seated users). Third, tensioning system 80 can provide custom tension levels in different seat cover regions in order to enhance user comfort. For example, a tension in an inner thigh/crotch region may be reduced to create less cover resistance in these areas.

Optional tensioning system 80 includes plural projections 81, 82, 83, and 84. Projections 81 and 82 are stationary projections extending from frame 10 while projections 83 and 84 are respectively mounted on bolts 85 and 86 that are movable along each bolt axis. Cable 27 incudes a first portion 27', a second portion 27'', and a third portion 27''' that that extend from seat cover 20. Cable first portion 27' encircles projections 81, 81' and 83 while cable second portion 27'' encircles projections 82, 82' and 84. Projections 81 and 82 may align the cable in the vertical plane compared to projections 83 and 84. Projections 81' and 82' may align the cable in the horizonal plane compared to 83 and 84. This is just one embodiment of the system to align the cable with the travel direction of 83 and 84. Projections 81, 81', 82 and 82' may be extensions of the frame 10 or screws or other fasteners. Washers may be used to reduce the friction of the cable 27 when it is being tensioned. Importantly, the tensioning system 80 can provide different custom tensions in different directions (e.g., horizontal and vertical) to ensure a custom comfort level to the seated user. Although the tensioning system 80 is shown as an example, many tensioning techniques may be used, preferably tensioning systems that can vary the tensions in different directions.

Cable length may be adjusted by selecting the number of times the cable encircles the projections, thereby changing the seat cover tension. Seat cover tension is further adjusted by advancing or retracting bolts 85 and 86 which further alters cable length. Through the action of tensioning system 80, many centimeters cable length can be adjusted. This permits the tensioning system to adequately compensate for any cover manufacturing variations as well as compensating for any cover sagging after prolonged seat use. Since manufacturing deviations are typically on the order of several centimeters, the tensioning system 80 ensures that nearly all manufactured parts can be used as seat covers, reducing production waste.

To provide optional further cover tensioning, particularly in selected cover regions, mechanical fasteners (for example, hooks engaging cable 27 or loops in cable 27) may be provided between cable 27 and optional further projections or apertures in the seat frame 10. Such projections may be similar to frame projections 81 and 82 and may hook or loop to the fabric cover 20/cable 27; alternatively, frame apertures may be provided to receive fasteners from the seat cover periphery.

The materials of seat cover 20 may be selected from a wide variety of woven, nonwoven, and knitted fabrics. As used herein, woven fabrics refer to fabrics that use at least two sets of yarns (for example, one or more warp and weft yarns) that typically cross each other at right angle to form the fabric grain; in tri-axial fabrics two sets of warp yearns are used positioned at 60 degrees to the weft while tetra-axial fabrics use four sets at 45 degrees to each other. In contrast, knitted fabrics begin with a single yarn that is interlaced to form loops. Nonwoven fabrics are those in which fibers are bonded, interlocked, intermingled, by mechanical, chemical, and/or thermal techniques to form a unified final fabric and include fibers that are laminated together to form a unified structure, such as felts.

Woven fabrics may include conventional two-dimensional woven fabrics or engineered three-dimensional fabrics in which weaving continues in the thickness direction to create regions having selectable mechanical properties. For example, regions of higher strength and higher density can be formed in the third dimension of the woven fabric.

Knitted fabrics may be conventional knitted fabrics (two-dimensional knitted) or custom-engineered three-dimensional knitted fabrics. Three-dimensional knitting is a knitting technique that allows for the creation of three-dimensional shapes and structures and can thus conform to the extreme curves of ergonomic seat frame 10. Unlike traditional knitting, which creates a flat piece of fabric that can be shaped through cutting and sewing, three-dimensional knitting involves knitting the object in a seamless, three-dimensional form. The process of three-dimensional knitting involves the use of specialized computer-controlled knitting machines that can create complex structures and shapes by using multiple yarns and stitches. The machines can create knitted pieces that are thicker or thinner in different areas to create a three-dimensional shape, and can also change the stitch density and pattern to create texture and structure. Three-dimensional knitting begins with a computer-aided design (CAD) file that specifies the shape and dimensions of the object to be knitted. The CAD file is then translated into machine-readable instructions that are sent to a computer-controlled knitting machine. The knitting machine uses a process called "warp knitting" to create the three-dimensional shapes. In warp knitting, the yarn is held in a stationary position on the machine while a series of needles move up and down to form stitches. The knitting machine can use multiple yarns and stitch patterns simultaneously to create complex shapes and textures.

As a result of the above techniques, three-dimensional knitting creates a precise, customized fit to the ergonomic seat frame 10's shape and dimensions. Further, the resulting seat cover is more breathable and comfortable, as it is made from high-quality, stretchable yarns that maintain their shape and support over time. Since three-dimensional knitting offers a wider range of design possibilities, the flexible seat cover 20 can be knitted in a variety of patterns and colors to create custom seat colors and patterns for individual users.

In contrast, conventional meshes for chairs are typically woven materials made by weaving a flat sheet of synthetic or natural fibers into a mesh pattern. The resulting mesh is then attached to a chair frame to create the seat and/or seat back. Conventional meshes have several disadvantages. For example, conventional mesh tends to stretch and sag over time, which can lead to discomfort and decreased support. Additionally, conventional mesh may be prone to fraying and tearing. Further, conventional meshes cannot be used on the extreme ergonomic structures of frame 10.

Various yarns may be used in the three-dimensional knitted fabrics used for the seats of the present invention. In general, the selected yarns should be strong, durable, and comfortable to sit on. Pliable regions may include one or more elastomeric yarns as well. Three-dimensional yarns include:

- Nylon: Nylon is a synthetic fiber known for its strength, durability, and abrasion resistance. It may be used in the present three-dimensional knitted seat covers due to its ability to withstand repeated use and wear.
- Polyester: Polyester is another synthetic fiber may be used in cover 20 for its resistance to wrinkles, shrinking, and fading.
- Merino wool: Merino wool is a soft and breathable natural fiber that is naturally moisture-wicking and temperature-regulating, making it a comfortable choice for prolonged sitting.
- Cotton: Cotton is a natural fiber that is soft and comfortable to sit on. Although less durable, it is moisture-wicking and breathable.
- Acrylic: Acrylic is a synthetic fiber may be used as a wool substitute in three-dimensional knitting for since it is less expensive and more durable than wool.

Elastomeric fibers may also be used for seat covers 20 to provide additional stretch and flexibility to the covers. Elastomeric fibers are synthetic fibers that have the ability to stretch and return to their original shape. They may be used in combination with one or more of the other fibers described above to create covers that are both stretchy and resilient.

In covers 20, elastomeric fibers can optionally be incorporated into particular regions to provide custom pliability in specific areas of the seat. For example, inner thigh regions/crotch regions 26 and buttocks regions 28 can optionally be more flexible to provide better comfort and support; therefore, elastomeric fibers can be added to those specific areas of the seat cover 20. Examples of elastomeric yarns include:

- Spandex: Spandex is a type of elastane fiber that is known for its high stretch and recovery properties. It may be used in seat cover 20 and to provide custom pliability and support.
- Lycra: Lycra is a branded type of spandex that is known for its elasticity and durability and can be used in for seat cover 20 to provide flexibility and comfort.
- Elastane: Elastane is a generic term for synthetic elastomeric fibers that are similar to spandex. They may be used in seat cover 20 to enhance stretch and recovery properties.
- Nylast: Nylast is a type of nylon elastomeric fiber that is known for its high elasticity and strength. It is often used in three-dimensional knitting for automotive seat covers and other applications that require durability and flexibility.
- Thermoplastic elastomers (TPEs): TPEs are a group of synthetic elastomers that can be molded or extruded into various shapes and forms, including fibers that are flexible, durable, and resistant to chemicals and UV light.

In the embodiment of FIG. 1, three-dimensional woven or knitted fabrics are used to accommodate the three-dimensional curved ergonomic frame shape 10. As described above, because three-dimensional knitting can match complex shapes, unlike two-dimensional fabrics/meshes, three-dimensional knitting is uniquely suited to complement the intricate curved profile of frame 10.

In a further embodiment, three-dimensional knitting may optionally be used to create regions have different pliability/resistance to deformation. Using these kinds of engineered fabrics, regions 25 may to selected to have higher fabric density/different strength yarns that function as support structures, transferring the weight of the user to the frame. In contrast, regions 26 and 28 have relatively more open knitted regions, less resistance to an applied load and feel more pliable to the user. These regions are particularly used where the thighs and buttocks contact the chair and thus deform in a way that conforms to the user's personal anatomy. In one aspect, the pliability of inner thigh regions 26 is particularly yielding/elastic in order to ensure user comfort. A more open structure with greater yarn spacing also ensures breathability. Further, due to the overall elastic nature of seat cover 20, optional padding can be placed beneath the cover 20 in the region of seat projection 29.

Figure 6A:
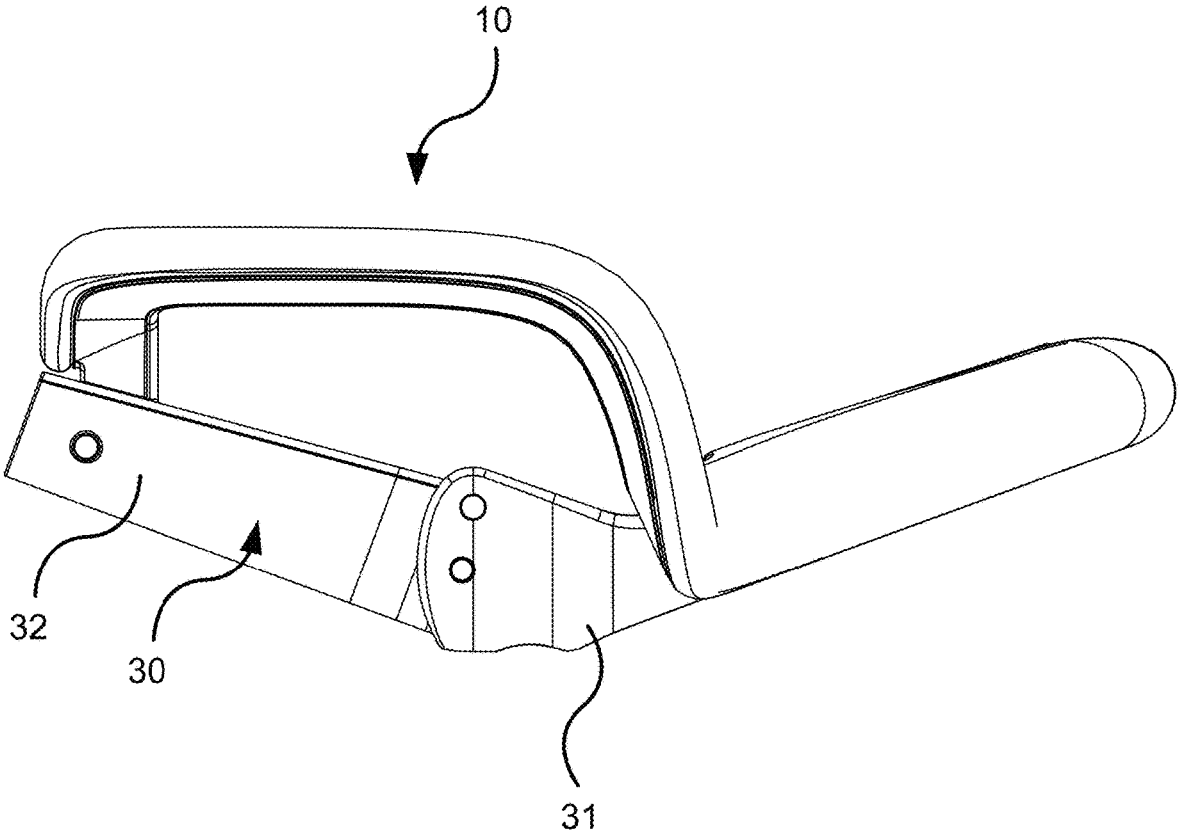
FIG. 6A shows a side view of an optional seat tilt adjuster for the ergonomic seat of FIG. 1.
Figure 6B:
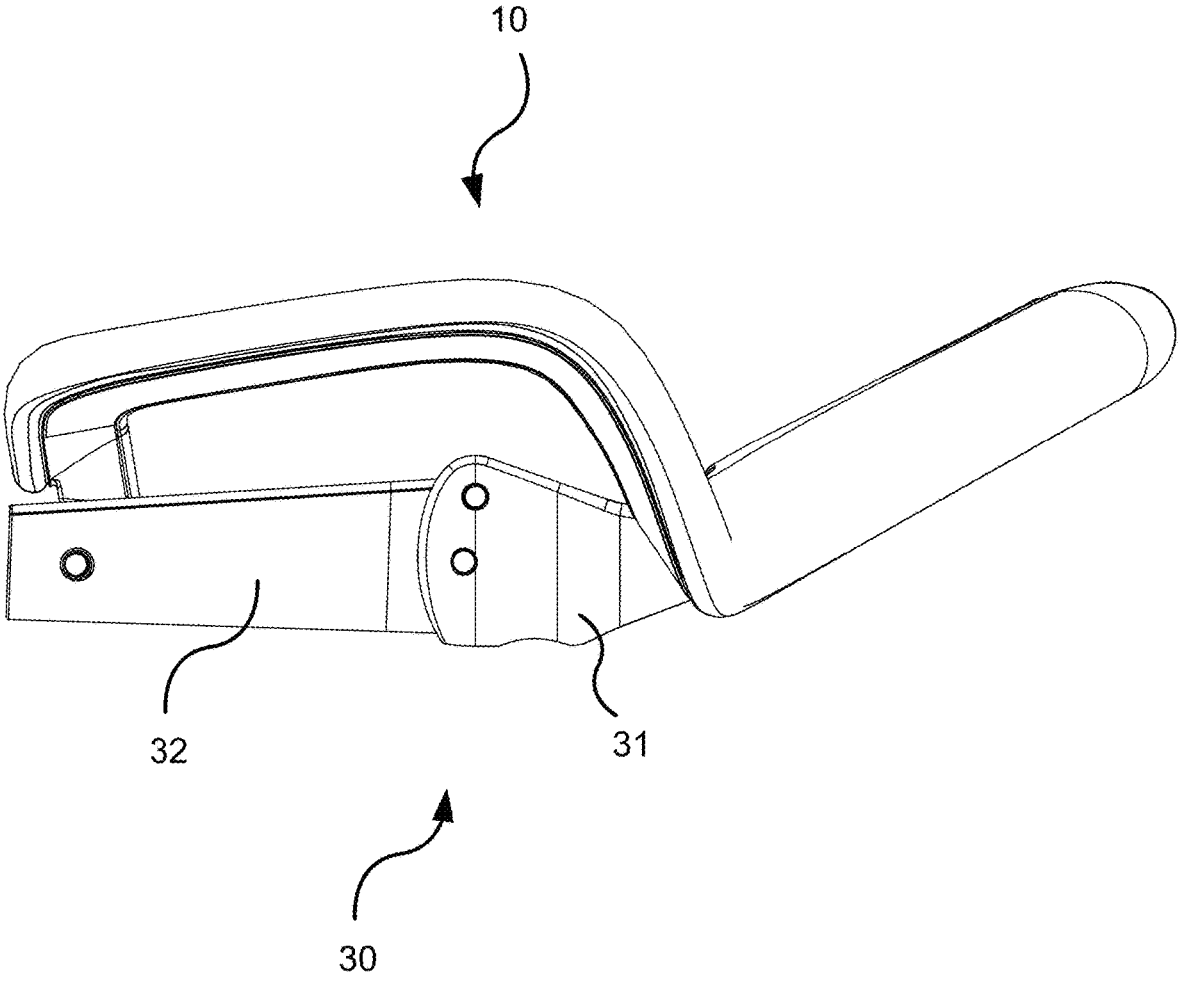
FIG. 6B shows the optional seat tilt adjuster of FIG. 6A in a reclined position.
Figure 7:
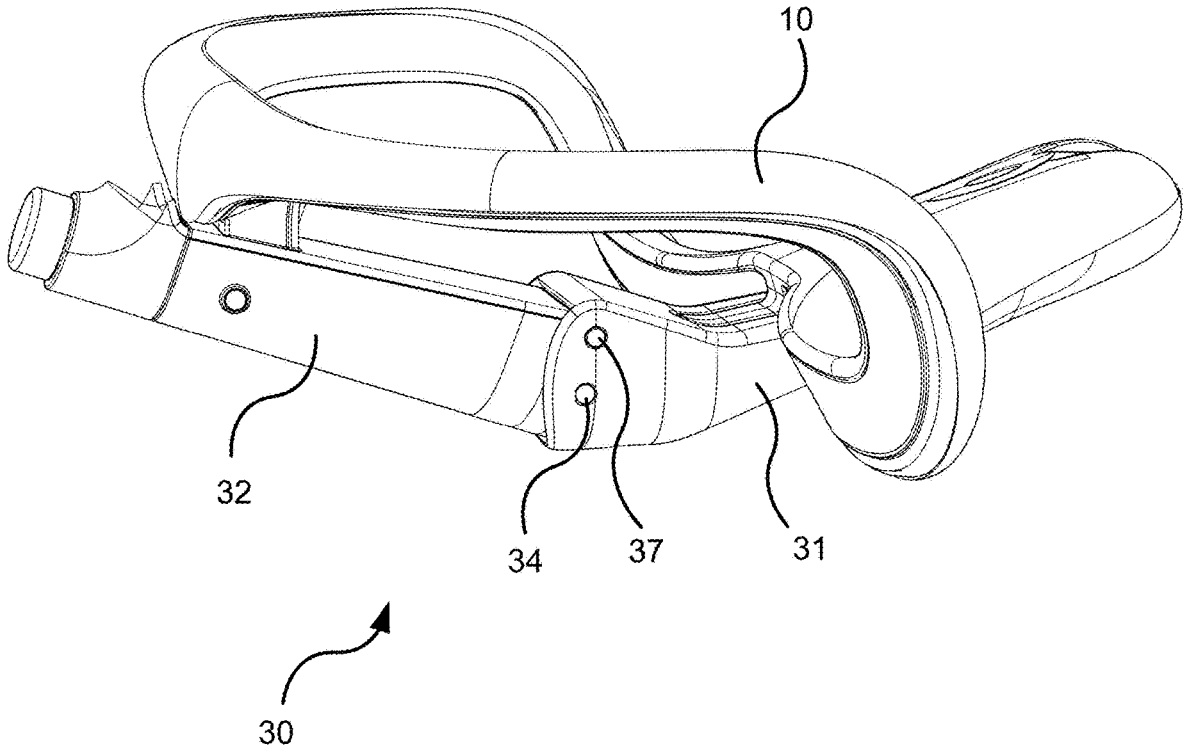
FIG. 7 shows a perspective view of an optional seat tilt adjuster for the ergonomic seat of FIG. 1.
Figure 8:
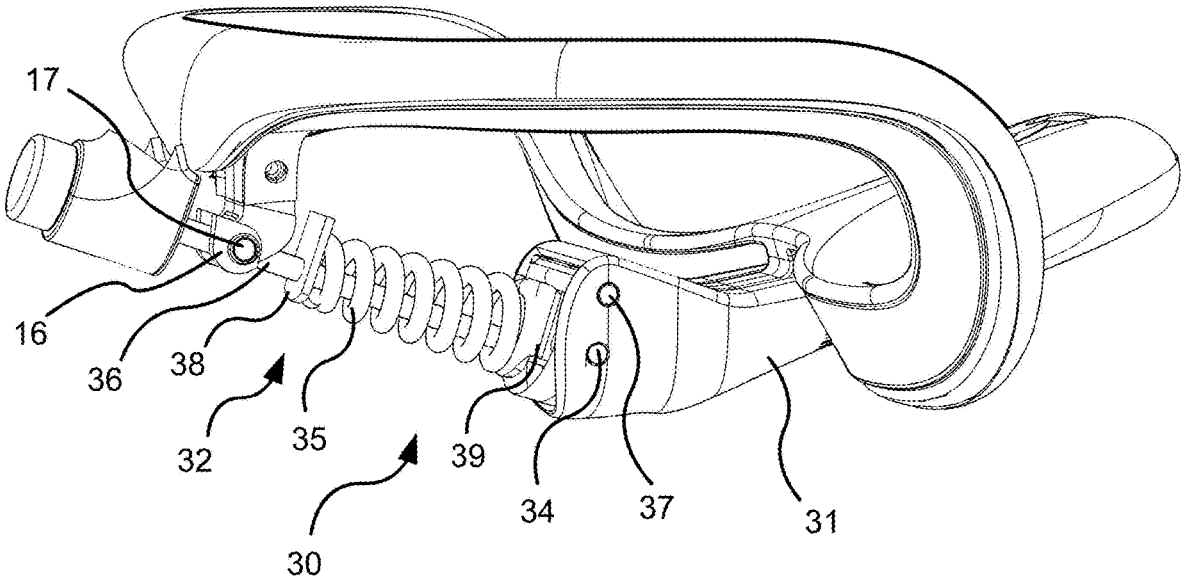
FIG. 8 shows an enlarged view of the seat tilt adjuster of FIG. 7 with a cover removed.
Figure 9:
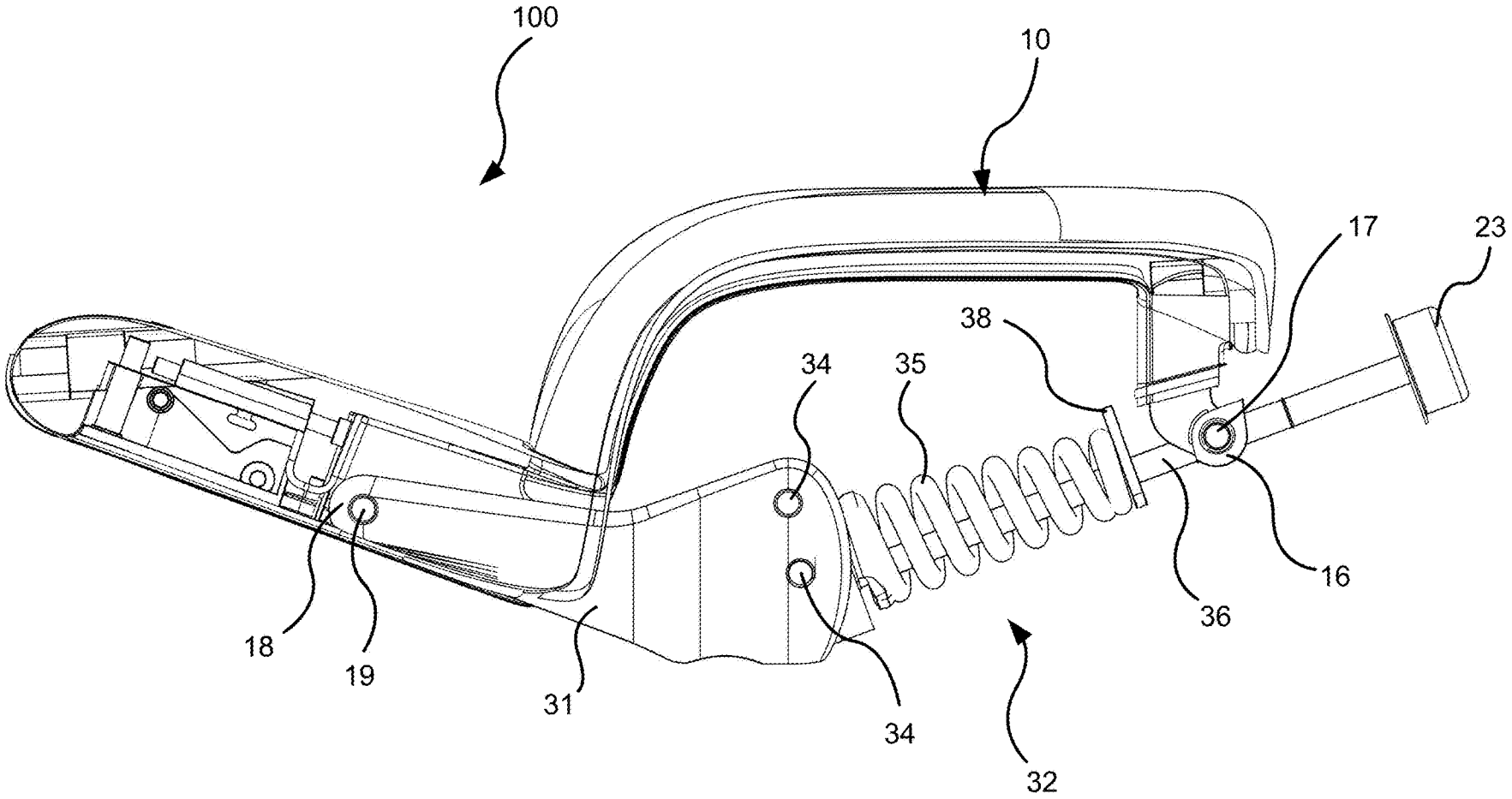
FIG. 9 is a side view of the optional seat tilt adjuster of FIG. 6A.
Figure 10:
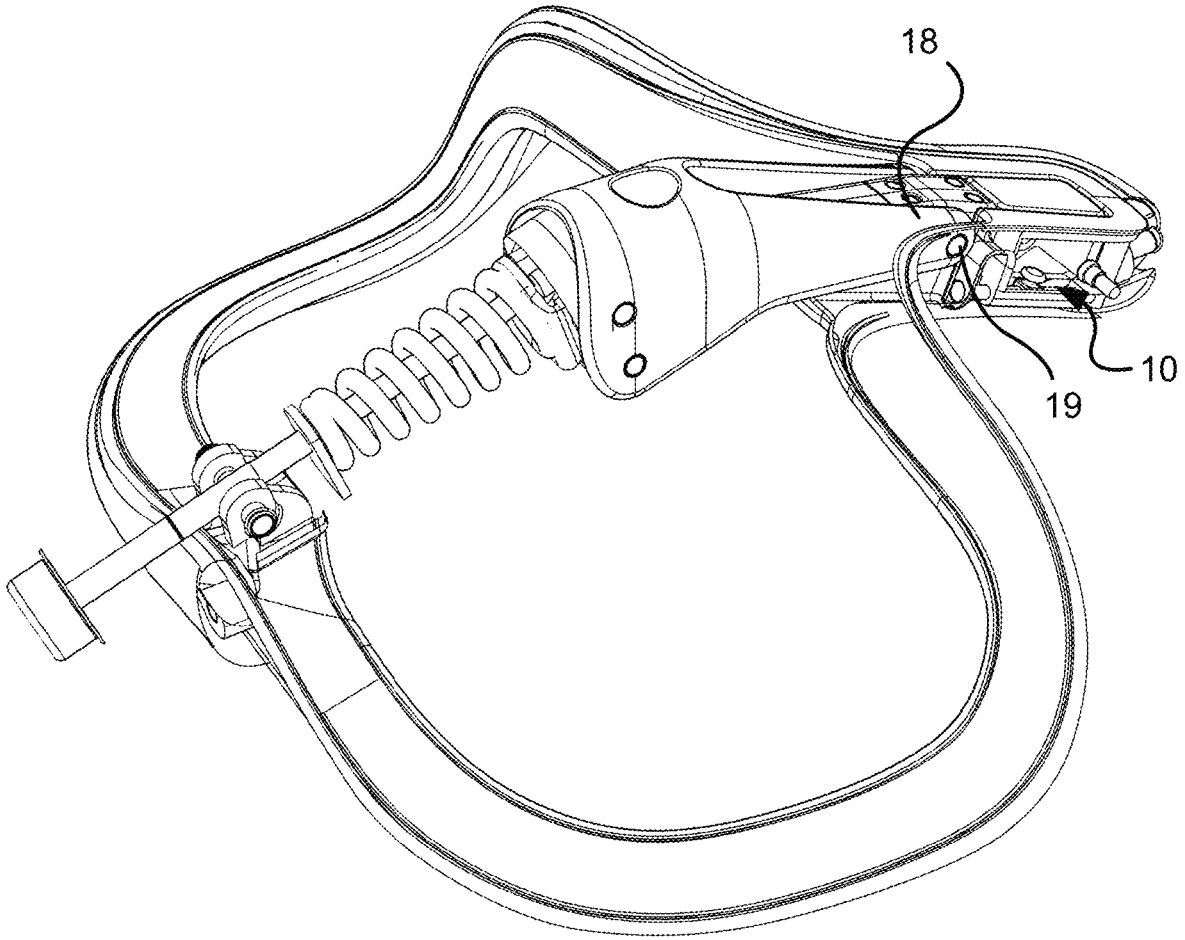
FIG. 10. is a close up of a pivot connection of the seat adjuster of FIG. 6A.

In an optional embodiment, the ergonomic seat may include a seat tilt adjuster 30, as seen in FIGS. 6A-6B In FIG. 6A, the seat is positioned in the untilted state while in FIG. 6B the seat is tilted backwards. FIGS. 7-9 depict the seat tilt adjuster 30 in further detail. In FIG. 7, a perspective view of a seat frame 10 with set tilt adjuster 30 positioned underneath is depicted. Seat tilt adjuster 30 includes stationary arm 31 and pivoting arm 32 which pivots about pivot point 37. Turning to FIG. 8, the seat tilt adjuster 30 is depicted in a side view with a cover for pivoting arm 32 removed. Pivoting arm 32 includes compression spring 35 concentrically-disposed over a spring axis rod 36. Compression spring 35 abuts a rotatable spring stop 39 at one end and abuts an adjustable spring stop 38 at the other end. As best seen in FIG. 9, seat tilt adjuster 30 is attached to the frame 10 rear portion through frame lower surface projection 16 connected by a fastener 17. In the front section of frame 10, shown in the side view of FIG. 9 and the enlarged perspective view of FIG. 10, seat tilt adjuster 30 is attached to the frame 10 front portion at pivot point 18 using a pivotal fastener 19. An enlarged view of pivot point 18 and pivotal fastener 19 is provided in FIG. 10.

The pivoting arm 32 pivots between 0-20 degrees around axis 37. The seat pivots between 0-10 degrees around axis 19. This pivoting action is made possible by rotatable stop 39 that pivots about axis 34 in connection with stationary arm 31. The movements are connected in a 2:1 ratio; however, other ratios may be selected based on the application for seat 100 (e.g., for office furniture, 2:1 may be useful but other apparatus incorporating seat 100 may select other ratios).

Adjustable spring stop 38 advances and withdraws in accordance with the rotation of tensioner rotational knob 33. As spring stop 38 pushes against compression spring 35 the degree of compression of spring 35 increases. Through the selected degree of spring compression, the seated user can determine the ease with which the seat reclines. Alternatively, knob 33 can be in direct contact with the flexible arm 32 (for stools with no backrests) or in direct contact though an extension piece (for chairs with backrests in which a base of the backrest extends to the seat tilt adjuster), depending upon a selected length of compression spring axis rod 36.

While the seat tilt adjuster has been described with respect to a spring-based mechanism, it is understood that other tilt mechanisms may also be used, including, but not limited to, a piston-based seat tilt mechanism. Piston-based seat tilt mechanisms typically use a pneumatic cylinder, which is filled with compressed air, to control the tilt of the chair seat. When the chair is tilted, the air pressure within the cylinder changes, allowing the seat to tilt forward or backward. Resistance to tilting is adjusted by increasing or decreasing the pressure within the cylinder, typically through the use of a push-button or other pressure-based actuator.

Figure 11:
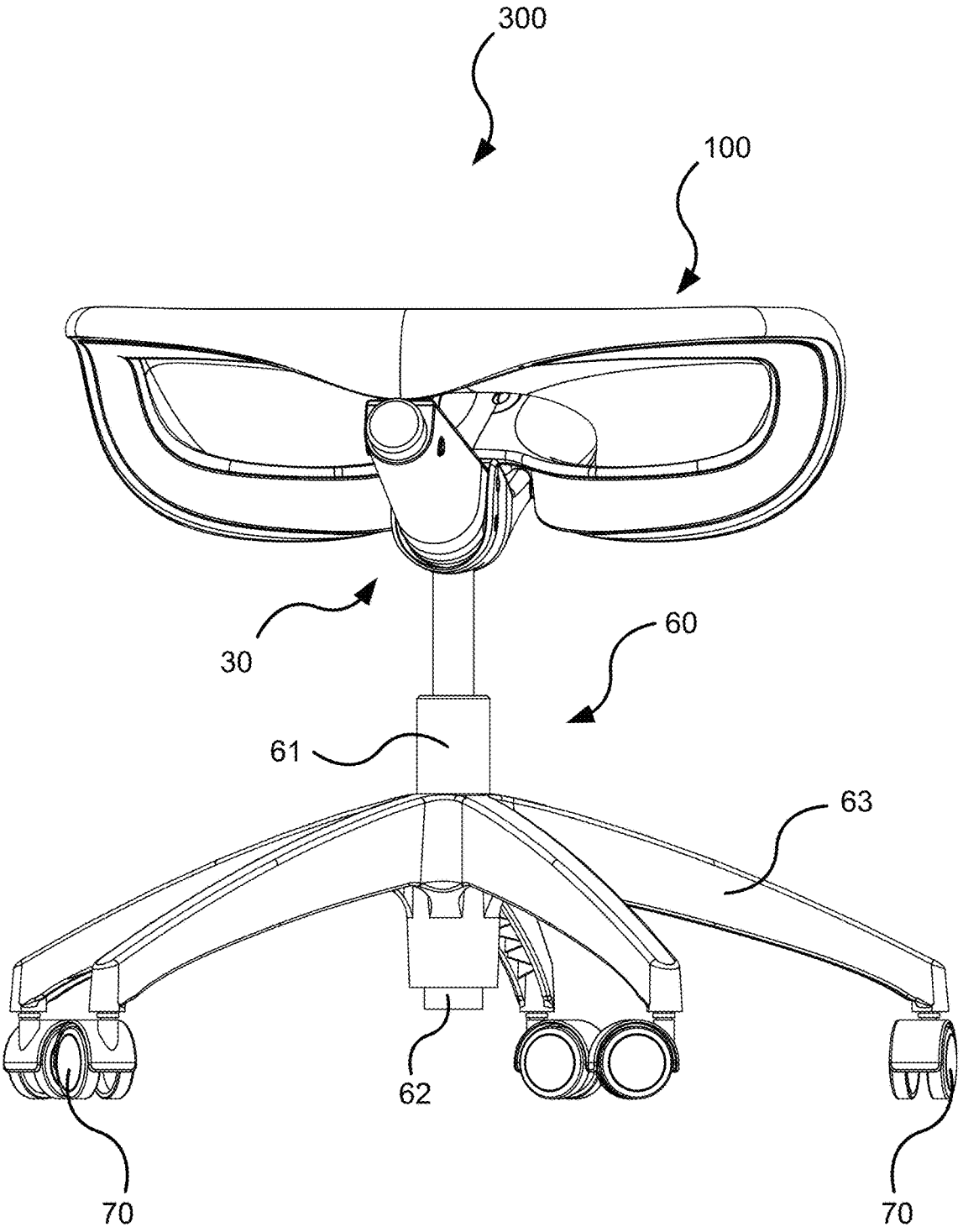
FIG. 11 shows a stool incorporating the ergonomic seat of claim 1.
Figure 12:
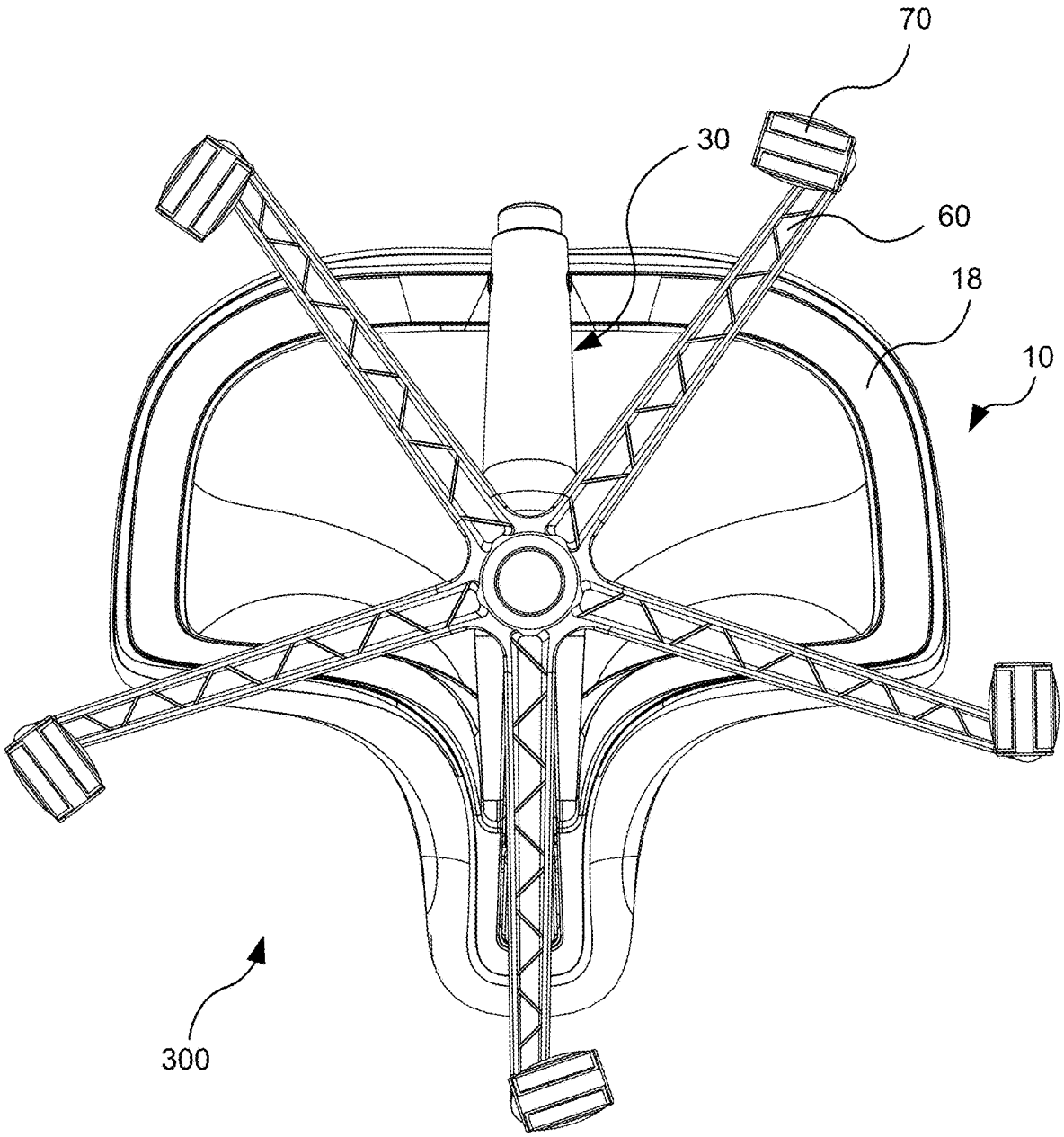
FIG. 12 shows a bottom view of the stool of FIG. 11.

The ergonomic seats of the present invention find particular use for stools and chairs. An example of a stool 300 is depicted in FIG. 11. In FIG. 11, ergonomic seat 100 is supported by base 60. Base 60 may be a height-adjustable base that includes piston-based height adjuster 61 and height adjuster control 62. Piston-based height adjuster may use a pneumatic cylinder, filled with compressed air having its resistance adjusted through air-pressure adjuster control knob 62. Base 60 extends into plural legs 63 that may optionally include wheels 70. FIG. 12 shows a bottom view of stool 300 showing the arrangement of base 60, tilt adjuster 30, and frame 10.

Figure 13:
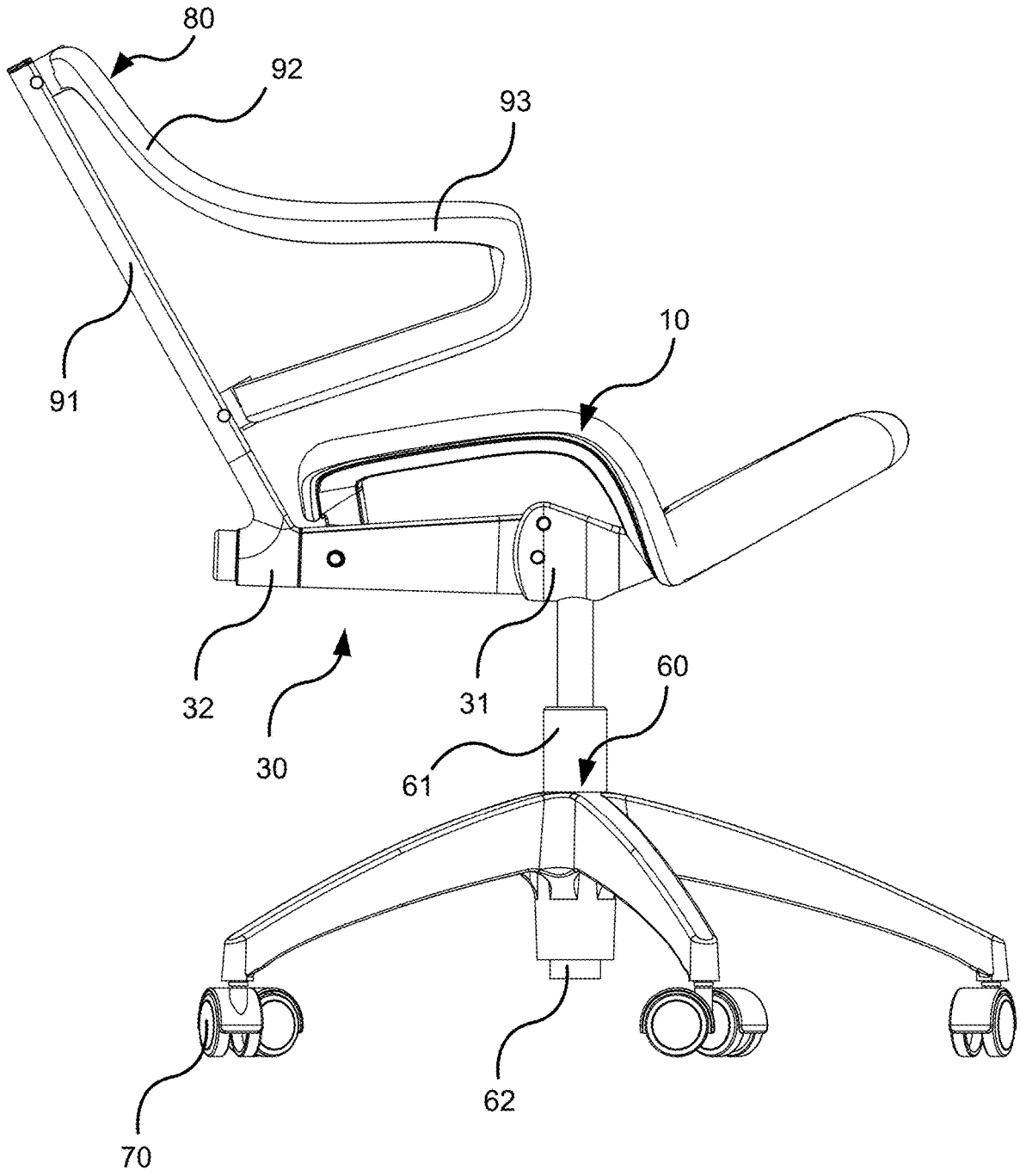
FIG. 13 shows a chair frame incorporating the seat frame of FIG. 2.

The ergonomic seats of the present invention may also be used in chairs that include a seat back. FIG. 13 depicts an example of ergonomic seat frame 10 attached to a backrest frame 90 to form a chair frame. It is understood that a wide variety of backrests may be used with seat frame 10 to form a chair; therefore FIG. 13 is only one embodiment of a chair frame incorporating seat frame 10. Backrest frame 90 includes a main backrest support rod 91 extending from seat tilt adjuster 30. In the embodiment of FIG. 13, the support rod 91 cooperates with seat tilt adjuster 30 such that the seat back tilts along with seat frame 10. In the configuration of FIG. 13, the seat back frame 90 tilts approximately 2 degrees for each 1 degree of recline of seat frame 10 (due to the selected location of the pivot points along the length of seat tilt adjuster 30). The embodiment of FIG. 13 is configured to accept a flexible backrest cover 95 in the same manner as seat cover 20 is attached to seat frame 10. To this end, a backrest frame 92 attached to support rod 91 includes integrated armrest frame portions 93. In this manner, a seamless backrest cover may span the backrest and armrests, as seen in the completed chair 400 of FIG. 14.

Figure 14:
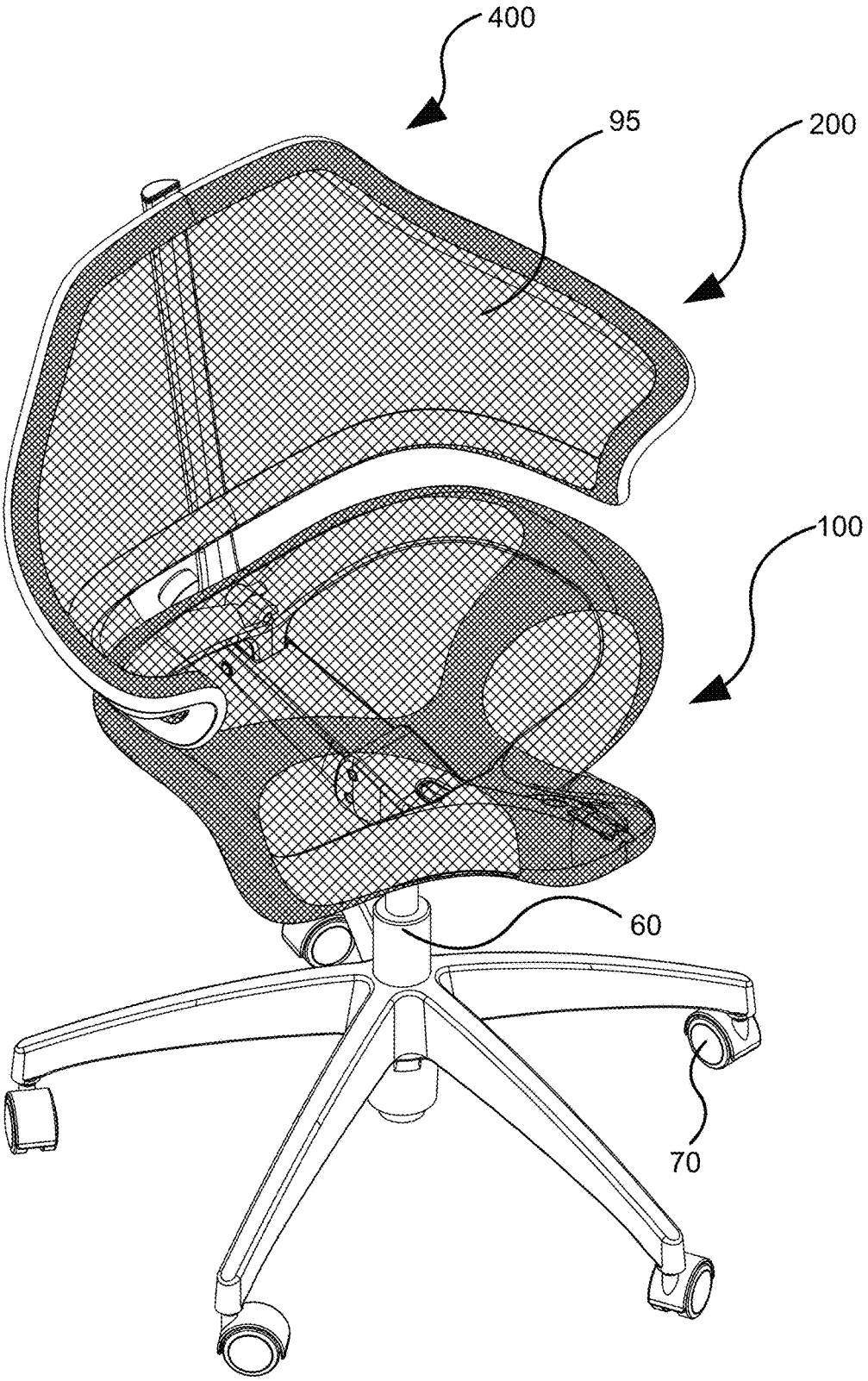
FIG. 14 shows a chair incorporated the chair frame of FIG. 13.

FIG. 14 shows a chair 400 with backrest 200 and ergonomic seat 100 incorporating tilt adjuster 30, base 60, and wheels 70. As seen in FIG. 14, backrest cover 95 seamlessly extends across the entire backrest frame 90 and may be secured to frame 90 in a similar manner as seat cover 20 is secured to frame 10. The seat cover 95 may be a three-dimensionally knitted fabric cover that optionally includes at least first and second regions of different knitting densities. The three-dimensional knitted fabric seat cover may optionally include first and second regions of knitting with different types of knitting yarns or fibers. One region may have a relatively higher knitting density for structural support to transfer a seated user's weight to the multi-part open seat frame, while another region includes a relatively lower compliant knitting density to yield to the seated user's individual anatomy.

The foregoing description of the present invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated.

As used herein and not otherwise defined, the terms "substantially," "substantial," "approximately" and "about" are used to describe and account for small variations. When used in conjunction with an event or circumstance, the terms can encompass instances in which the event or circumstance occurs precisely as well as instances in which the event or circumstance occurs to a close approximation. For example, when used in conjunction with a numerical value, the terms can encompass a range of variation of less than or equal to +10% of that numerical value, such as less than or equal to +5%, less than or equal to +4%, less than or equal to +3%, less than or equal to +2%, less than or equal to +1%, less than or equal to +0.5%, less than or equal to +0.1%, or less than or equal to +0.05%.

As used herein, the singular terms "a," "an," and "the" may include plural referents unless the context clearly dictates otherwise. In the description of some embodiments, a component provided "on" or "over" another component can encompass cases where the former component is directly on (e.g., in physical contact with) the latter component, as well as cases where one or more intervening components are located between the former component and the latter component.

While the present disclosure has been described and illustrated with reference to specific embodiments thereof, these descriptions and illustrations are not limiting. It should be understood by those skilled in the art that various changes may be made and equivalents may be substituted without departing from the true spirit and scope of the present disclosure as defined by the appended claims. The illustrations may not necessarily be drawn to scale. There may be distinctions between the artistic renditions in the present disclosure and the actual apparatus due to manufacturing processes and tolerances. There may be other embodiments of the present disclosure which are not specifically illustrated. The specification and the drawings are to be regarded as illustrative rather than restrictive. Modifications may be made to adapt a particular situation, material, composition of matter, method, or process to the objective, spirit, and scope of the present disclosure. All such modifications are intended to be within the scope of the claims appended hereto. While the methods disclosed herein have been described with reference to particular operations performed in a particular order, it will be understood that these operations may be combined, sub-divided, or re-ordered to form an equivalent method without departing from the teachings of the present disclosure. Accordingly, unless specifically indicated herein, the order and grouping of the operations are not limitations.

The invention claimed is:

1. An ergonomic seat comprising:

a multi-part open seat frame defining an ergonomic seat periphery; and a flexible seat cover attached to the multi-part open seat frame;

wherein the multi-part open seat frame comprises:

a first seat sub-frame; and a second seat sub-frame;

wherein the first seat sub-frame and the second seat sub-frame are pivotally connected such that each of the first seat sub-frame and the second seat sub-frame is independently pivotable about a horizontal axis such that each of the first seat sub-frame and the second seat sub-frame is independently foldable upward and downward with respect to each other, providing a changeable shape to the multi-part open seat frame; and wherein the flexible seat cover includes a seat cover tensioner including one or more projections, a peripheral pocket extending along a periphery of the flexible seat cover, and a flexible cable received in the peripheral pocket and connected to the seat cover tensioner, the flexible cable having a length shorter than a perimeter of the multi-part open seat frame in a fully open position;

wherein the flexible seat cover is positioned over the multi-part open seat frame by a process comprising:

folding the multi-part open seat frame to accommodate the flexible seat cover;

engaging the seat cover peripheral cable to the one or more projections of the seat cover tensioner; and opening the multi-part open seat frame to tension the flexible cable and stretch the flexible seat cover over the multi-part open seat frame to enable the flexible seat cover to conform to the contours of the multi-part open seat frame and maintain its shape over time.

2. The ergonomic seat of claim 1, further comprising a mechanical hinge positioned at a pivotal connection between the first seat sub-frame and the second seat sub-frame.

3. The ergonomic seat of claim 1, wherein the flexible seat cover is a three-dimensionally knitted fabric seat cover.

4. The ergonomic seat of claim 3, wherein the three-dimensional knitted fabric seat cover includes at least first and second regions of different knitting densities.

5. The ergonomic seat of claim 4, wherein the first region includes a relatively higher knitting density for structural support to transfer a seated user's weight to the multi-part open seat frame, and the second region includes a relatively lower compliant knitting density to yield to the seated user's individual anatomy.

6. The ergonomic seat of claim 3, wherein the three-dimensional knitted fabric seat cover includes first and second regions of knitting with different types of knitting yarns or fibers.

7. The ergonomic seat of claim 1, wherein the multi-part open seat frame includes a curved frame rear portion adapted to complement shape of an average adult human being seating on the ergonomic seat.

8. The ergonomic seat of claim 7, further comprising a front projection positioned between legs of an average adult human being seating on the ergonomic seat;

wherein the open frame and front projection are configured to allow the average adult human being seating on the ergonomic seat to position her back at an angle of between approximately 115-135 degrees with respect to her thighs.

9. The ergonomic seat of claim 1, further comprising a seat tilt adjuster positioned beneath the multi-part open seat frame.

10. The ergonomic seat of claim 9, wherein the seat tilt adjuster includes a stationary arm pivotally connected to a pivoting arm.

11. The ergonomic seat of claim 10, wherein the pivoting arm includes an adjustable compression spring.

12. The ergonomic seat of claim 11, wherein the pivoting arm further comprises a pivotable spring stop abutting the adjustable compression spring.

13. The ergonomic seat of claim 1, wherein the multi-part open seat frame includes at least a portion having a frame cross-section with a curved portion transitioning to a flat lower portion to engage a periphery of the seat cover.

14. The ergonomic seat of claim 1, further comprising a backrest cooperating with the ergonomic seat.

15. The ergonomic seat of claim 14, wherein the backrest includes an open backrest frame, and a flexible backrest cover attached to the open backrest frame.

16. The ergonomic seat of claim 1, wherein the first and second sub-frames are oriented side-to-side or front to back of the multi-part open seat frame.

* * * * *